United States Patent [19]

Ichiki

[11] Patent Number: 4,696,214

[45] Date of Patent: Sep. 29, 1987

[54] ELECTRONIC MUSICAL INSTRUMENT

[75] Inventor: Tetsuji Ichiki, Hamamatsu, Japan

[73] Assignee: Nippon Gakki Seizo Kabushiki Kaisha, Hamamatsu, Japan

[21] Appl. No.: 917,909

[22] Filed: Oct. 10, 1986

[30] Foreign Application Priority Data

Oct. 15, 1985 [JP] Japan ..... 60-229081

[51] Int. Cl.[4] ..... G10H 7/00

[52] U.S. Cl. ..... 84/1.01; 84/1.28

[58] Field of Search ..... 84/1.01, 1.03, 1.11–1.13, 84/1.19–1.28

[56] References Cited

U.S. PATENT DOCUMENTS 4,584,921 4/1986 Wachi ..... 84/1.01

4,622,877 11/1986 Strong ..... 84/1.01

*Primary Examiner*—S. J. Witkowski

*Attorney, Agent, or Firm*—Spensley Horn Jubas & Lubitz

[57] ABSTRACT

An electronic musical instrument of the sampling type is provided. The electronic musical instrument comprises a memory having a plurality of storage areas, and operates in one of full sampling, part sampling, full play and part play modes. Sampling data of waveform of a tone are stored into addresses of all the storage areas in the full sampling mode, and are stored into addresses of one of the storage areas in the part sampling mode. Thus, only one waveform is sampled and stored in the full sampling mode, whereas a plurality of waveforms can be sampled and stored in the part sampling mode. In the full play mode, the whole sampling data are read from the storage areas to form a tone, so that the tone can have a complicated waveform if the sampling data have been stored in the memory in the part sampling mode. In the part play mode, the sampling data are read from the corresponding storage area, so that the tone can be formed from a portion of a waveform if the waveform has been stored in the full sampling mode.

7 Claims, 19 Drawing Figures

FIG.6(a)
FIG.6(b)
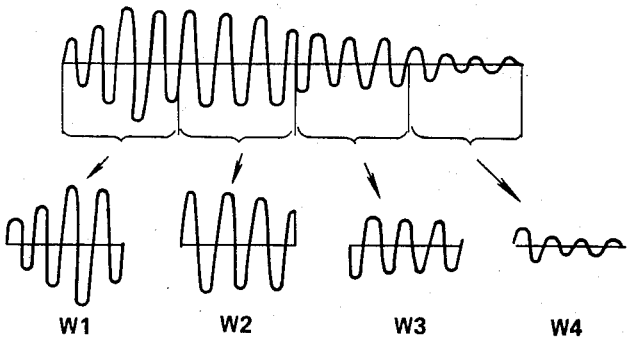
FIG.6(c)
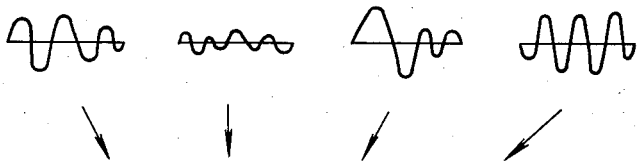
FIG.6(d)
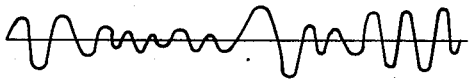

| | MODE (3) | MODE (4) |
|---|---|---|
| C2 | 2.00 K | 8.00 K |
| C #2 | 2.12 K | 8.47 K |
| ⋮ | ⋮ | ⋮ |
| C3 | 4.00 K | 16.00 K |
| C #3 | 4.24 K | 8.47 K |
| ⋮ | ⋮ | ⋮ |
| C4 | 8.00 K | 16.00 K |
| C #4 | 8.47 K | 8.47 K |
| ⋮ | ⋮ | ⋮ |
| C5 | 16.00 K | 16.00 K |
| C #5 | 16.94 K | 8.47 K |
| ⋮ | ⋮ | ⋮ |
| C6 | 32.00 K | 16.00 K |

ELECTRONIC MUSICAL INSTRUMENT

BACKGROUND OF THE INVENTION

1. Field of the Invention

The present invention relates to an electronic musical instrument of the type which stores data obtained by sampling a tone and generates a tone based on the stored data.

2. Prior Art

There has been proposed an electronic musical instrument of the sampling type which stores data obtained by sampling a tone of an acoustic musical instrument into an associated memory and produces a tone in accordance with the stored sampled data. Such an electronic musical instrument, wherein the stored sampled data serves as a tone source, is disclosed, for example, in Japanese Patent Application Laid-Open No. 54-161313. This conventional electronic musical instrument operates in one of two modes, namely, a part sampling mode and a full sampling mode. A memory provided in the electronic musical instrument is divided, in the part sampling mode, into a plurality of storage areas which are assigned to key zones of the keyboard, respectively. Each of the storage areas stores data representative of a tone in response to a depression of a key in a corresponding one of the key zones, whereby a plurality of groups of data representative respectively of different tones can be stored in the memory. When a key on the keyboard is depressed, the data in the area corresponding to the key zone of the depressed key are read out at a rate determined by the corresponding key zone to form a tone.

With the conventional electronic musical instrument, although tones of different waveshapes can be generated, the generation of each tone is effected based only on the tone data stored in the corresponding storage area in the part sampling mode. Thus, each tone generated by this conventional electronic musical instrument is liable to be monotonous.

When the conventional electronic musical instrument operates in the full sampling mode, the plurality of storage areas are used as a single storage area for storing data representative of a tone. In this case, the generation of tone is performed based only on the tone data stored in the full sampling mode. Thus, although tones of different pitches can be generated in this mode, their wave shapes are identical to each other, so that the tones are liable to be monotonous.

SUMMARY OF THE INVENTION

It is therefore an object of the present invention to provide an electronic musical instrument which stores a plurality of groups of tone data obtained by respectively sampling different tones into a memory and uses the plurality of groups of tone data as a plurality of tone sources to generate a single complex-waveshape tone.

It is another object of the invention to provide an electronic musical instrument which stores tone data obtained by sampling a single tone into a memory and uses a plurality of portions of the tone data as tone sources to generate a plurality of tones, respectively.

According to a first aspect of the present invention, there is provided an electronic musical instrument comprising mode selection means for selecting one of a plurality of modes including sampling and play modes, the mode selection means outputting a mode signal representative of the selected mode; transducer means for converting a tone into a tone signal representative of the tone; memory means comprising a plurality of storage areas each having a plurality of addresses; read/write rate designation means for outputting a first rate signal designating a first rate of access to the addresses of the memory means when the mode signal represents the sampling mode, and for outputting a second rate signal designating a second rate of access to the addresses of the memory means when the mode signal represents the play mode; storage area designation means for designating one of the plurality of storage areas and for outputting an area signal indicative of the designated storage area; read/write control means responsive to the mode signal, the first rate signal and the area signal for storing data representing the tone signal into the addresses in the designated storage area only at the first rate when the mode signal represents the sampling mode, and responsive to the mode signal and the second rate signal for reading data from the addresses in the plurality of storage areas at the second rate when the mode signal represents the play mode; and tone generating means for generating a tone in accordance with the data read from the memory means.

According to a second aspect of the invention, there is provided an electronic musical instrument comprising mode selection means for selecting one of a plurality of modes including sampling and play modes, the mode selection means outputting a mode signal representative of the selected mode; transducer means for converting a tone into a tone signal representative of the tone; memory means comprising a plurality of storage areas each having a plurality of addresses; read/write rate designation means for outputting a first rate signal designating a first rate of access to the addresses of the memory means when the mode signal represents the sampling mode, and for outputting a second rate signal designating a second rate of access to the addresses of the memory means when the mode signal represents the play mode; storage area designation means for designating one of the plurality of storage areas and for outputting an area signal indicative of the designated storage area; read/write control means responsive to the mode signal and the first rate signal for storing data representing the tone signals into the addresses in the plurality of storage areas at the first rate when the mode signal represents the sampling mode, and responsive to the mode signal, the second rate signal and the area signal for reading data from the addresses in the designated storage area only at the second rate when the mode signal represents the play mode; and tone generating means for generating a tone in accordance with the data read from the memory means.

BRIEF DESCRIPTION OF THE DRAWINGS

FIG. 6(*a*) is an illustration showing a waveform of tone sampled and stored in the memory GM in the full sampling mode;

FIG. 6(*b*) is an illustration showing waveforms of tones formed in the part play mode based on the stored waveform of FIG. 6(*a*);

FIG. 6(*c*) is an illustration showing waveforms of tones sampled and stored in the memory GM in the part sampling mode;

FIG. 6(*d*) is an illustration showing a waveform of tone formed in the full play mode based on the stored waveforms of FIG. 6(*c*);

DESCRIPTION OF THE PREFERRED EMBODIMENT OF THE INVENTION

Figure 1:
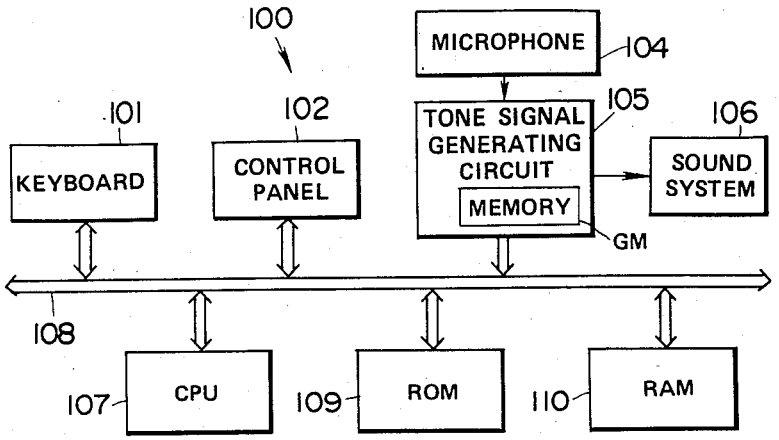
FIG. 1 is a block diagram of an electronic musical instrument 100 provided in accordance with one embodiment of the present invention.
Figure 2:
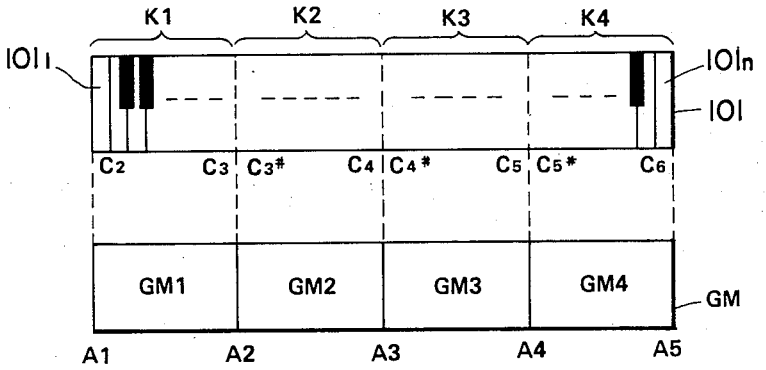
FIG. 2 is an illustration showing the keyboard 101 and the memory GM of the electronic musical instrument 100 of FIG. 1.
Figure 3:
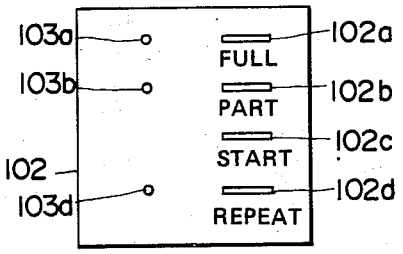
FIG. 3 is an illustration showing the control panel 102 of the electronic musical instrument 100 of FIG. 1.

Referring now to FIG. 1, there is shown an electronic musical instrument 100 provided in accordance with one embodiment of the present invention. The electronic musical instrument 100 comprises a keyboard 101 and a control panel 102. The keyboard 101 comprises, as shown in FIG. 2, a plurality of keys $\mathbf{101}_1$ to $\mathbf{101}_n$ corresponding respectively to C2 tone to C6 tone, so that the tone range is four octaves plus one note. As shown in FIG. 3, the control panel 102 has thereon a full mode switch 102*a*, a part mode switch 102*b*, a start switch 102*c* and a repeat mode switch 102*d*. The control panel 102 further comprises three LED indicators 103*a*, 103*b* and 103*d* which correspond respectively to the full mode, part mode and repeat mode switches 102*a*, 102*b* and 102*d*. Shown at 104 in FIG. 1 is a microphone which receives a tone, converts the received tone into an analog electric signal and supplies the signal to a tone signal generating circuit 105. The tone signal generating circuit 105 samples the analog signal fed from the microphone 104 at a predetermined rate, converts each sampled signal into digital data, and stores the digital data into an internal memory GM. The tone signal generating circuit 105 also forms a tone signal representative of a tone from the data stored in the memory GM and outputs the tone signal to a sound system 106.

The memory GM provided in the tone generating circuit 105 comprises, as shown in FIG. 2, four storage areas GM1 to GM4 each having a plurality of memory locations or addresses. The lowest or start addresses of the storage areas GM1 to GM4 are designated respectively by reference characters A1 to A4, and the highest or end address of the storage area GM4 is designated by reference characters A5. The sound system 106 comprises an amplifier for amplifying the tone signal and a loudspeaker driven by the output from the amplifier, and outputs a musical sound from the loudspeaker.

Figure 4:
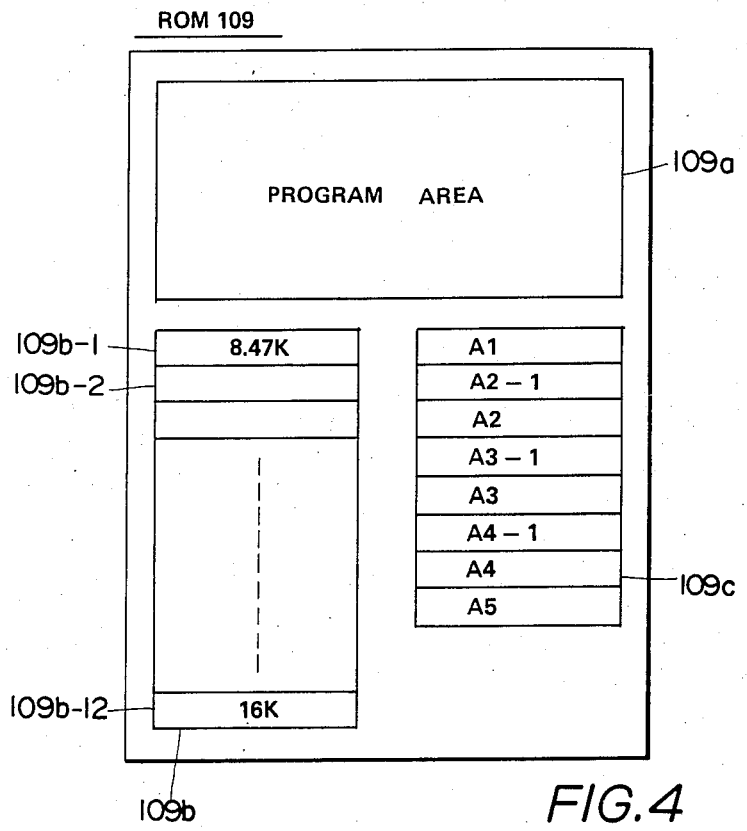
FIG. 4 is an illustration showing areas of the ROM 109 for storing various data.
Figure 5:
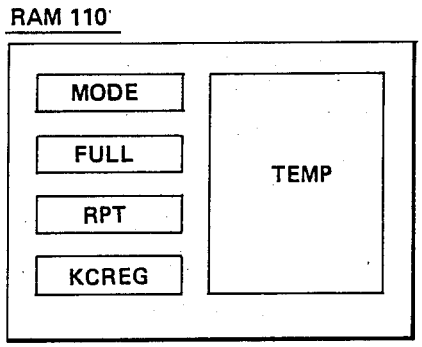
FIG. 5 is an illustration showing registers and a storage area provided in the RAM 110 of the electronic musical instrument 100 of FIG. 1.

A central processing unit (CPU) 107 is connected through a signal bus 108 to various circuit portions of this electronic musical instrument 100 including the keyboard 101, control panel 102 and tone signal generating circuit 105. Also connected to the signal bus 108 are a ROM 109 and a RAM 110. The ROM 109 comprises, as shown in FIG. 4, a program area 109*a* for storing various programs to be executed by the CPU 107, a frequency number areas (FN areas) 109*b* for storing twelve frequency numbers, and an address area 109*c* for storing address data indicative of the start addresses A1, A2, A3 and A4 of the respective storage areas GM1 to GM4 and address data indicative of the end addresses (A2 - 1), (A3 - 1), (A4 - 1), and A5 of the storage areas GM1 to GM4 (see FIG. 2). Detailed description as to the frequency numbers will be given later. The RAM 110 provides therein four registers MODE, FULL, RPT and KCREG and a temporary storage area TEMP, as shown in FIG. 5.

The operation of this electronic musical instrument 100 will now be described.

The electronic musical instrument 100 operates in one of four modes as follows:

(1) Full Sampling Mode

This mode is selected to join all the areas GM1 to GM4 together to form one storage area into which data representative of a single tone should be stored. The electronic musical instrument 100 is brought into this mode when the operator depresses the full mode switch 102*a* on the control panel 102. As a result of the depression of the full mode switch 102*a*, the LED indicator 103*a* lights up. The operator sets the microphone 104 for receiving a tone, and then depresses one of the keys (C#4) to (C5) which corresponds to a pitch of the tone to be received. Subsequently, the operator causes the tone to be stored to be generated and depresses the start switch 102*c*. As a result, the tone received by the microphone 104 begins to be sampled and converted into digital data, and the thus obtained digital data are sequentially stored into the addresses A1 to A5 of the memory GM. In this case, the sampling rate of the tone is determined by the pitch corresponding to the depressed one of the keys (C#4) to (C5).

(2) Part Sampling Mode

This mode is selected to store four groups of data representative of four individual tones to be stored respectively into the storage areas GM1 to GM4 of the memory GM. In this mode, the key board 101 is imaginarily divided into four key zones K1, K2, K3 and K4 which correspond respectively to the keys (C2) to (C3), keys (C#3) to (C4), keys (C#4) to (C5) and keys (C#5) to (C6), as shown in FIG. 2.

The operator first depresses the part mode switch 102*b* on the control panel 102 to bring this electronic musical instrument 100 into this part sampling mode. As a result of the depression of the switch 102*b*, the LED indicator 103*b* lights up. Then, the operator sets the microphone 104 for receiving a tone, and depresses one of the keys in the key zone K1 which corresponds to a pitch of the first one of the four tones to be stored. Subsequently, the operator causes the first tone to be generated and then depresses the start switch 102*c*. As a result, the first tone received by the microphone 104 begins to be sampled and converted into digital data, and the thus obtained digital data are sequentially stored into the storage area GM1 of the memory GM.

In a similar manner, data representative of the second to fourth ones of the four tones are stored respectively into the storage areas GM2 to GM4.

(3) Full Play Mode

This mode is selected when the operator plays a music on the keyboard 101 using the data stored in the storage areas GM1 to GM4 as a single tone source. In this mode, the tone signal generating circuit 105 generates, in response to each key depression, a tone signal based on the entire tone data stored in the memory GM.

The electronic musical instrument 100 is brought into this mode when the operator depresses the full mode switch 102*a* on the control panel 102. As a result of the depression of the switch 102*a*, the lED indicator 103*a* goes out. Then, the operator begins to play a music on the keyboard 101. When any one of the keys of the keyboard 101 is depressed, the stored tone data are sequentially read out of the storage areas GM1 to GM4 of the memory GM at a rate corresponding to the pitch corresponding to the depressed key. Each of the tone data thus read out is converted into an analog signal and supplied to the sound system 106. As a result, a tone corresponding to the depressed key is outputted from the sound system 106.

(4) Part Play Mode

This mode is selected when the operator plays a music selectively using one of the four groups of tone data stored in the storage areas GM1 to GM4. The electronic musical instrument 100 is brought into this mode when the operator depresses the part mode switch 102*b* on the control panel 102. As a result of the depression of the switch 102*b*, the LED indicator 103*b* goes out. The operator then begins to play a music on the keyboard 101.

In this mode, the tone signal is formed by using one of the four groups of data stored in the storage areas GM1 to GM4. More specifically, when one of the keys within the key zone K1 is depressed, the storage area GM1 is accessed to sequentially read out the stored sampled data from the address A1 to the address (A2 - 1) at a rate corresponding to the pitch corresponding to the depressed key. Each of the read out data is converted into an analog form to produce the tone signal. Similarly, when one of the keys within the key zone K2 is depressed, the storage area GM2 is accessed to sequentially read out the stored sampled data to form the tone signal. The similar operation is true with the key zones K3 and K4.

Thus, with this embodiment, it is possible to play a music in the full play mode (3) using the tone data sampled and stored in the full sampling mode (1) and to play a music in the part play mode (4) using the tone data sampled and stored in the part sampling mode (2), as the conventional sampling-type electronic musical instrument. With this electronic musical instrument 100, it is also possible to play a music in the part play mode (4) using the tone data sampled and stored in the full sampling mode (1) (this case is referred to as "case 1") and to play a music in the full play mode (3) using the tone data sampled and stored in the part sampling mode (2) (this case is referred to as "case 2"). It is assumed here that the tone sampled and stored in the full sampling mode (1) has a waveform shown in FIG. 6(*a*). This waveform can be divided into four portions W1 to W4 as shown in FIG. 6(*b*). In the aforesaid case 1, the tone signal is formed based on one of the four waveforms W1 to W4 (FIG. 6(*b*)) which corresponds to that one of the key zones K1 to K4 to which the depressed key belongs. When four tones respectively having waveforms shown in FIG. 6(*c*) have been sampled and stored in the part sampling mode (2), the tone signal is formed based on a waveform shown in FIG. 6(*d*), which is a combination of the four waveforms of FIG. 6(*c*), in the aforesaid case 2. Thus, the electronic musical instrument 100 of FIG. 1 has a function of editing tone sources.

The structure of the tone signal generating circuit 105 will now be more fully described with reference to FIG. 7.

Figures 8, 9:
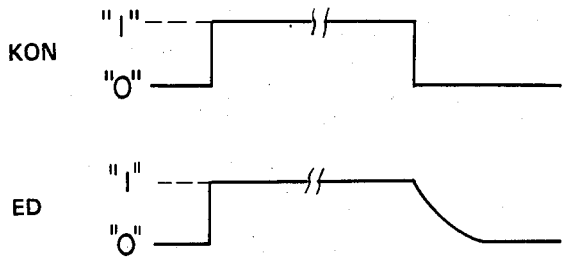
FIG. 8 is an illustration showing waveforms of the key-on signal KON and envelope data ED appearing in the circuit of the tone signal generating circuit 105 of FIG. 7.
FIG. 9 is an illustration showing the relation between the tones and the frequencies for storing or reading data representative of the tones.

The tone signal generating circuit 105 comprises an interface circuit 115 for communicating with the CPU 107 (FIG. 1) which is connected to the signal bus 108 through a terminal T1. The interface circuit 115 is connected to a mode register 116, a frequency number register (FN register) 117 and a flip-flop 118. The interface circuit 115 is also connected to a differentiator 119, which outputs a pulse signal in response to a trailing edge of an input signal thereto, a key-on register 120, a repeat mode register 121, a start address register 122 and an end address register 123. Each of the mode register 116, key-on register 120 and repeat mode register 121 is composed of a one-bit register. An output of the FN register 117 is supplied to a gate circuit 124 which opens when a "1" signal is supplied to an enable terminal EN thereof and closes when a "0" signal is supplied to the enable terminal EN. An output of the gate circuit 124 is supplied to an accumulator 125 which accumulates the output of the gate circuit 124 in response to each pulse of a clock pulse signal $\phi$. Shown at 126 is a differentiator which outputs a pulse signal in response to a leading edge of an input signal thereto. An output of the accumulator 125 is supplied to a change detection circuit 127 which detects a change of the output of the accumulator 125 to output a pulse signal P1. An adder 128 adds both outputs of the accumulator 125 and the start address register 122 together, and outputs a predetermined number of higher-order bits of the addition result to an address input terminal AD of the memory GM and to an input terminal A of a comparator 129. The comparator 129 compares the output of the adder 128 with an output of the end address register 123 fed to another input terminal B thereof, and outputs a coincidence signal EQ of "1" when both outputs coincide with each other. An analog-to-digital (A/D) converter 130 is supplied through a terminal T2 with an analog output signal of the microphone 104 (FIG. 1) and converts the supplied analog signal into digital data. The digital data is supplied to a data input terminal DATA1 of the memory GM. The memory GM further comprises a data output terminal DATA2, a write-pulse input terminal WP and a read/write control terminal R/W. This memory GM writes the data applied to the data input terminal DATA1 into the address designated by the address data applied to the address input terminal AD when a pulse signal of "1" is supplied to the write pulse input terminal WP with the read/write control terminal R/W being supplied with a "1" signal. On the other hand, when the read/write control terminal R/W is supplied with a "0" signal, the memory GM reads the data contained in the address designated by the address data applied to the address input terminal AD, and output the read data from the data output terminal DATA2. An envelope generator 131 is responsive to a key-on signal KON outputted from the key-on register 120 to generate envelope data ED. As shown in FIG. 8, the envelope data ED is changed from "0" to "1" when the key-on signal KON rises to "1", held at "1" during the time when the key-on signal KON is "1", and gradually decreased to "0" after the key-on signal KON falls to "0". The data from the memory GM and the envelope data ED are supplied to a multiplier 132 which multiplies the data from the memory GM by the envelope data ED. An output of the multiplier 132 is supplied to a digital-to-analog (D/A) converter 133 which converts the output from the multiplier 132 into an analog signal and outputs it as the tone signal through an output terminal T3 to the sound system 106 (FIG. 1).

Description will now be given as to the frequency number FN.

The address data for designating the addresses of the memory GM which the sampled data are to be written into or read from are formed based on the frequency number FN. More specifically, the frequency number FN stored in the FN register 117 is less than "1" and accumulated by the accumulator 125, and the accumulation result is added by the adder 128 to the start address data. The adder 128 outputs an integer part of the addition result as address data to the address input terminal AD of the memory GM. In this case, the accumulation of the frequency number FN is performed at a constant interval of the clock signal $\phi$, and therefore when the frequency number FN is low, the frequency of the waveshape formed in accordance with the sampled data read from the memory GM becomes low. On the other hand, when the frequency number FN is high, the frequency of the waveshape formed in accordance with the sampled data read from the memory GM becomes high. Thus, the frequency number FN determines the cycle of reading of the sampled data from the memory GM, and determines the cycle of writing of the sampled data into the memory GM.

In this embodiment, the cycle of reading of the sampled data from the memory GM in the full play mode (3) and the part play mode (4) is changed in accordance with the pitch of tone of the depressed key, as shown in FIG. 9. Also, the cycle of writing of the sampled data into the memory GM is selected in accordance with the pitch of tone of the depressed key from those of the cycles enclosed by a dotted line in FIG. 9. The twelve frequency numbers FN corresponding respectively to the keys (C#4) to (C5) are previously stored in the FN area 109*b* of the ROM 109 (FIG. 4). The remaining frequency numbers FN are not stored in the ROM 109. The reason for this is that the remaining frequency numbers FN can be obtained by simply shifting the frequency numbers FN enclosed by the dotted line in FIG. 9. For example, in the case of the mode (3), the cycle of reading of 2 KHz of the sampled data for forming the C2 tone is half of the cycle of reading of 4 KHz of the sampled data for forming the C3 tone, since the ratio of frequency of one of two tones one octave apart from each other to the other is $\frac{1}{2}$. Similarly, the cycle of reading of 4 KHz of the sampled data for forming the C3 tone is half of the cycle of reading of 8 KHz of the sampling data for forming the C4 tone. This is true with the other frequency numbers FN.

The processing performed by the CPU 107 will now be more fully described with reference to flow charts shown in FIGS. 10 to 16.

When power is supplied to the electronic musical instrument 100, the CPU 107 begins to repeatedly scan key switches provided correspondingly to the keys (C2) to (C6) of the keyboard 101 and the switches 102*a* to 102*d* on the control panel 102 to detect any manipulation or event of the keys and switches. This scanning is performed by a main routine (not shown) executed by the CPU 107. When an event is detected, one of the following processings is performed:

(i) Full Switch ON Event

Figure 10:
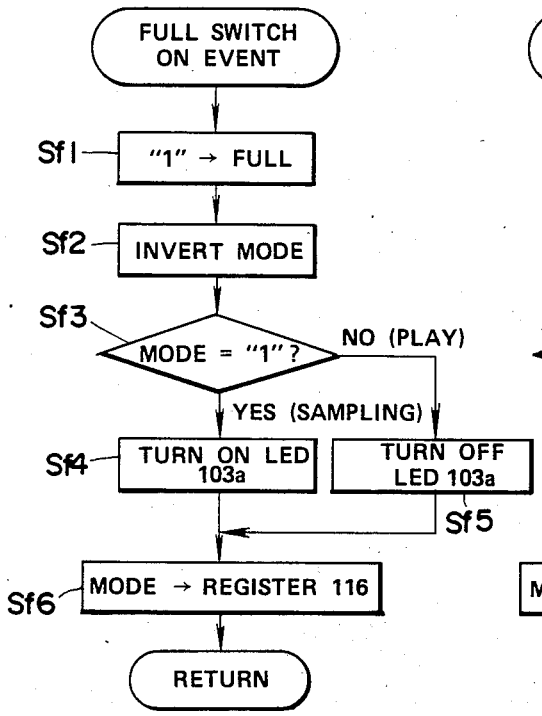
FIG. 10 is a flow chart of processing performed by the CPU 107 in response to an ON event of the full switch 102*a;*

When an ON event of the full switch 102*a* is detected, the CPU 107 stores "1" into the register FULL (FIG. 5) at step Sf1 of the flow chart of FIG. 10. The CPU 107 then inverts at step Sf2 the state of one-bit data contained in the register MODE (FIG. 5). At the next step Sf3, the CPU 107 determines whether the data in the register MODE is "1". If the result of determination at the step Sf3 is "YES", an ON command for the LED indicator 103*a* is outputted to the control panel 102 at step Sf4. On the other hand, if the determination result is "NO", then an OFF command for the LED indicator 103*a* is outputted to the control panel 102 at step Sf5. The processing then proceeds to step Sf6 at which the data contained in the register MODE is outputted to the mode register 116 (FIG. 7). Then, the processing returns to the main routine.

(ii) Part Switch ON Event

Figure 11:
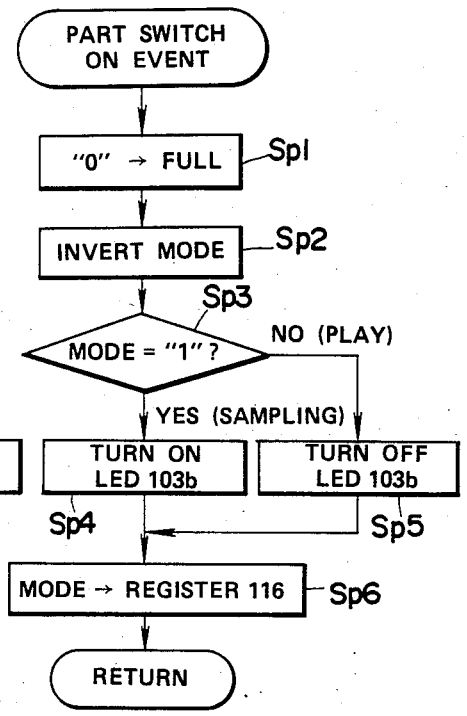
FIG. 11 is a flow chart of processing performed by the CPU 107 in response to an ON event of the part switch 102*b;*

When an ON event of the part switch 102*b* is detected, the CPU 107 first stores "0" into the register FULL at step Sp1 of the flow chart of FIG. 11. The CPU 107 then inverts the state of data contained in the register MODE at step Sp2. At the next step Sp3, the CPU 107 determines whether the data in the register MODE is "1". If the result of determination at the step Sp3 is "YES", an ON command for the LED indicator 103*b* is outputted to the control panel 102 at step Sp4. On the other hand, if the determination result is "NO", then an OFF command for the LED indicator 103*b* is outputted to the control panel 102 at step Sp5. The processing then proceeds to step Sp6 at which the data contained in the register MODE is outputted to the mode register 116. Then, the processing returns to the main routine.

The above-described processings are performed to bring the electronic musical instrument 100 into any one of the full sampling mode (1), part sampling mode (2), full play mode (3) and part play mode (4). More specifically, when the operator depresses the full switch 102*a* once, the register FULL is set to "1" and at the same time the register MODE is set, for example, to "1" whereupon the LED indicator 103*a* is turned on. Consequently, the electronic musical instrument 100 is brought into the full sampling mode (1). When the electronic musical instrument 100 should be brought into the full play mode (3), the operator again depresses the full switch 102*a*. Then, the state of the data in the register MODE is inverted with the data of "1" in the register FULL being unchanged, and the LED indicator 103*a* is turned off. This is true with the case where the part switch 102*b* is depressed.

It will be apparent from the above description that the electronic musical instrument 100 is brought into the full sampling mode (1) or full play mode (3) when the data contained in the register FULL is "1", and is brought into the part sampling mode (2) or part play mode (4) when the data is "0". It will be also apparent that the electronic musical instrument 100 is brought into the full sampling mode (1) or part sampling mode (2) when the data contained in the register MODE is "1", and is brought into the full play mode (3) or part play mode (4) when the data is "0".

(iii) Start Switch ON Event

Figure 12:
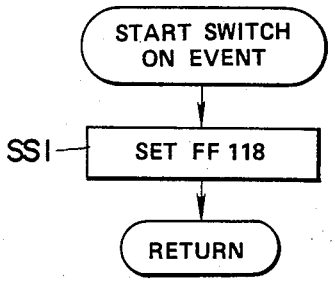
FIG. 12 is a flow chart of processing performed by the CPU 107 in response to an ON event of the start switch 102*c;*

When an ON event of the start switch 102*c* is detected, the CPU 107 sets the flip-flop 118 (FIG. 7) to "1" at step SS1 of the flow chart of FIG. 12, and then returns its control to the main routine.

(iv) Repeat Mode Switch ON Event

Figure 13:
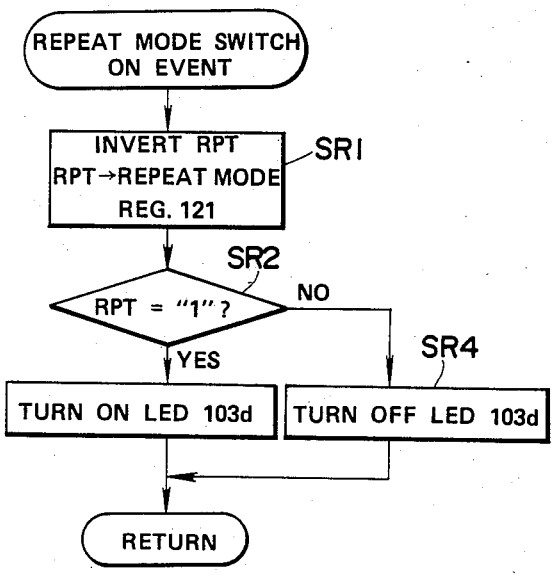
FIG. 13 is a flow chart of processing performed by the CPU 107 in response to an ON event of the repeat mode switch 102*d;*

When an ON event of the repeat mode switch 102*d* is detected, the CPU 107 inverts the state of the one-bit data contained in the register RPT (FIG. 5) and transfers the inverted data to the repeat mode register 121 (FIG. 7) at step SR1 of the flow chart of FIG. 13. The CPU 107 then determines whether the data in the register RPT is "1" at step SR2. If the result of determination at the step SR2 is "YES", an ON command for the LED indicator 103*d* is outputted to the control panel 102 at step SR3. On the other hand, if the determination result is "NO", an OFF command for the LED indicator 103*d* is outputted to the control panel 102 at step SR4. Then, the processing returns to the main routine.

This processing enables the operator to set the repeat mode register 121 to "1" or "0" in accordance with the depression of the repeat mode switch 102*d*. The state of the repeat mode register 121 is thus changed each time the operator depresses the repeat mode switch 102*d*.

(v) Key-ON event

Figure 14:
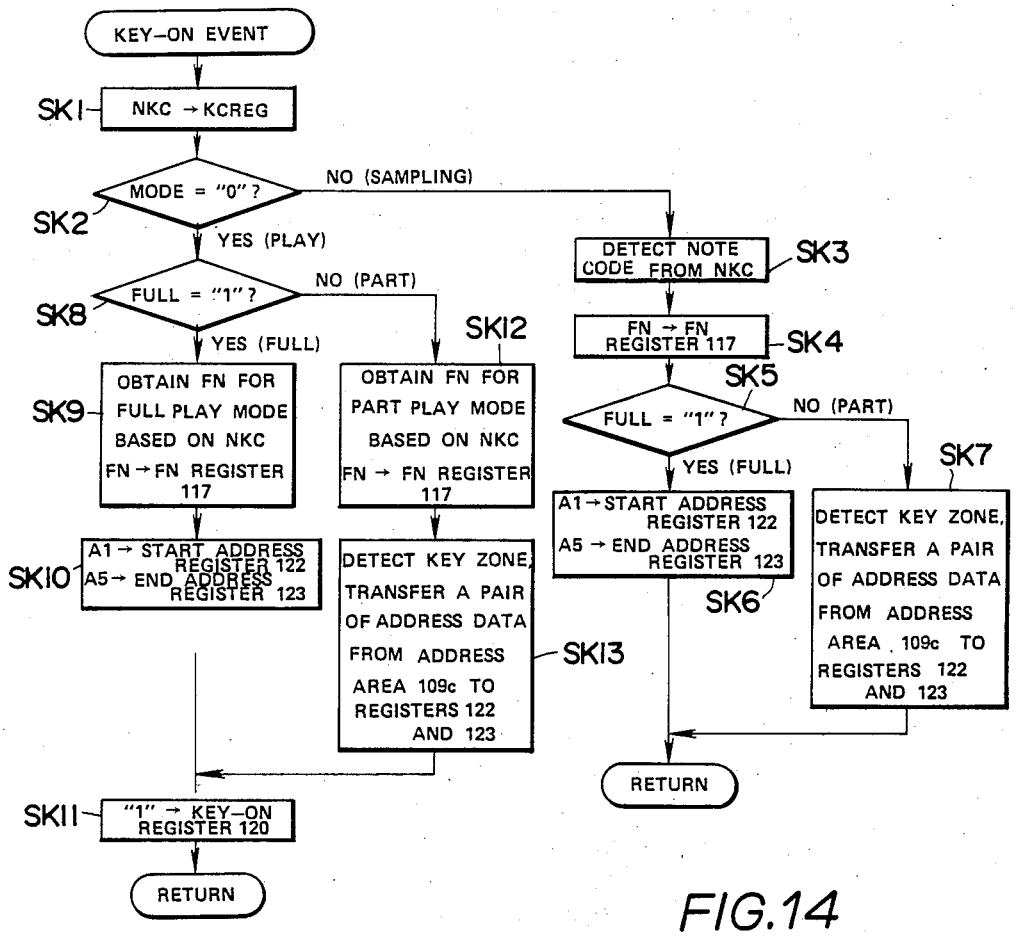
FIG. 14 is a flow chart of processing performed by the CPU 107 in response to an ON event of any key of the keyboard 101.

When an ON event or a depression of any key of the keyboard 101 is detected, the CPU 107 stores the key code NKC representative of the newly depressed key into the register KCREG (FIG. 5) at step SK1 of the flow chart of FIG. 14. The CPU 107 then determines at step SK2 whether the data contained in the register MODE is "0". If the result of determination at the step SK2 is "NO", that is to say, if the sampling mode (1) or (2) is selected, the processing proceeds to step SK3. At this step SK3, the CPU 107 detects a note code contained in the key code NKC in the register KCREG to determine a note name of the depressed key within the octave. At the next step SK4, one of the frequency numbers FN which corresponds to a note represented by the detected note code is read from the FN area 109*b* of the ROM 109 and transferred to the FN register 117 (FIG. 7). More specifically, when the note name of the depressed key is C♯, the frequency number FN in the address 109*b*-1 of the area 109*b* is transferred to the FN register 117, and when the note name is D the frequency number FN in the address 109*b*-2 is transferred to the FN register 117. Similarly, when the note name is C the frequency number FN in the address 109*b*-12 is transferred to the register 117. The processing then proceeds to the next step SK5 at which it is determined whether the data in the register FULL is "1". If the result of determination at the step SK5 is "YES", that is to say, if the full sampling mode (1) is selected, the processing proceeds to step SK6 at which a pair of address data indicative of the addresses A1 and A5 are read from the address area 109*c* and transferred respectively to the start and end address registers 122 and 123 (FIG. 7). On the other hand, if the determination result at the step SK5 is "NO", that is to say, if the part sampling mode (2) is selected, the processing proceeds to step SK7. At this step SK7, it is first detected to which of the key zones K1 to K4 the key represented by the key code NKC belongs. Then, a pair of address data indicative of the star and end addresses determined by the detected key zone are read from the address area 109*c* of the ROM 109 and transferred to the start and end address registers 122 and 123, respectively, in the following manner:

| (key zone) | (address data) | (start and end address registers) |
|---|---|---|
| K1 | A1 | start address register 122 |
| | A2 - 1 | end address register 123 |
| K2 | A2 | start address register 122 |
| | A3 - 1 | end address register 123 |
| K3 | A3 | start address register 122 |
| | A4 - 1 | end address register 123 |
| K4 | A4 | start address register 122 |
| | A5 | end address register 123 |

Then, the processing returns to the main routine.

When the determination result at the step SK2 is "YES", that is to say, when the play mode (3) or (4) is selected, the processing proceeds to step SK8 at which it is determined whether the data contained in the register FULL is "1". If the result of determination at the step SK8 is "YES", i.e., if the full play mode (3) is selected, the processing proceeds to step SK9. At this step SK9, the frequency number FN for the full play mode (3) (see FIG. 9) which corresponds to the key code NKC in the register KCREG is produced by reading a corresponding one of the frequency numbers FN from the FN area 109*b* and by subjecting the read frequency number FN to a bit shift processing. The thus produced frequency number FN is stored into the FN register 117 (FIG. 7). At the next step SK10, a pair of address data indicative of the addresses A1 and A5 are read from the address area 109*c* and transferred to the start address and end address registers 122 and 123, respectively. Then, data representative of "1" is stored into the key-on register 120 at step SK11, and the processing returns to the main routine.

On the other hand, when the determination result at the step SK8 is "NO", that is to say, when the part play mode (4) is selected, the processing proceeds to step SK12. At this step SK12, the frequency number FN for the part play mode (4) (see FIG. 9) which corresponds to the key code NKC in the register KCREG is produced, and the produced frequency number FN is stored into the FN register 117. Then, the processing proceeds to the next step SK13 at which the same processing as that performed at the step SK7 is carried out. The processing then returns to the main routine through the step SK11.

(vi) Key-OFF Event

Figure 15:
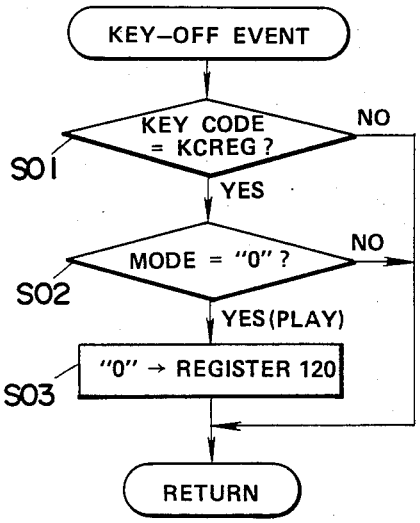
FIG. 15 is a flow chart of processing performed by the CPU 107 in response to an OFF event of any key of the keyboard 101.
Figure 16:
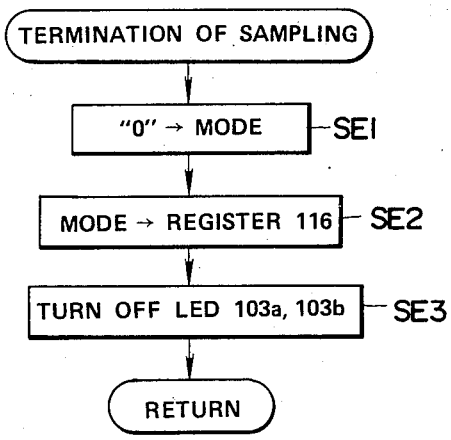
FIG. 16 is a flow chart of processing performed by the CPU 107 when a sampling operation is terminated.

When an OFF event or a release of any key on the keyboard 101 is detected, the CPU 107 determines at step SO1 of the flow chart of FIG. 15 whether the key code of the released key coincides with the key code NKC contained in the register KCREG. If the result of determination at the step SO1 is "YES", the processing proceeds to step SO2 to further determine whether the data in the register MODE is "0". If the result of determination at the step SO2 is "YES", that is to say, if this electronic musical instrument 100 is in the play mode (3) or (4), the processing proceeds to step SO3. At the step SO3, data representative of "0" is stored into the key-on register 120 (FIG. 7), and the processing then returns to the main routine. On the other hand, any of the determination results at the steps SO1 and SO2 is "NO", the processing directly returns to the main routine.

The aforesaid electronic musical instrument 100 is monophonic, so that only the tone of the last depressed key is produced. The key code NKC representative of the last depressed key is held in the register KCREG, and therefore when the determination result at the step SO1 is "NO", the tone corresponding to the newly released key has not been generated, so that no processing is required.

The foregoing are the processings carried out by the CPU 107 in response to occurrences of events. The CPU 107 also carries out the following processings:

(vii) Sampling Termination Processing

When the storing of sampled data into the memory GM is completed, the differentiator 119 outputs a pulse signal SE indicative of the completion by sampling by which the CPU 107 is interrupted. Upon receipt of the signal SE, the CPU 107 carries out the processing shown in FIG. 16. More specifically, the CPU 107 first stores data representative of "0" into the register MODE at step SE1, and then transfers the data contained in the register MODE to the mode register 116 (FIG. 7) at step SE2. At the next step SE3, the CPU 107 outputs OFF commands for the LED indicators 103*a* and 103*b* to the control panel 102, and then returns its control to the main routine.

The foregoing are the processings performed by the CPU 107.

The overall operation of the circuits shown in FIGS. 1 and 7 will now be described with respect to each mode.

(a) Full Sampling Mode

Figure 7:
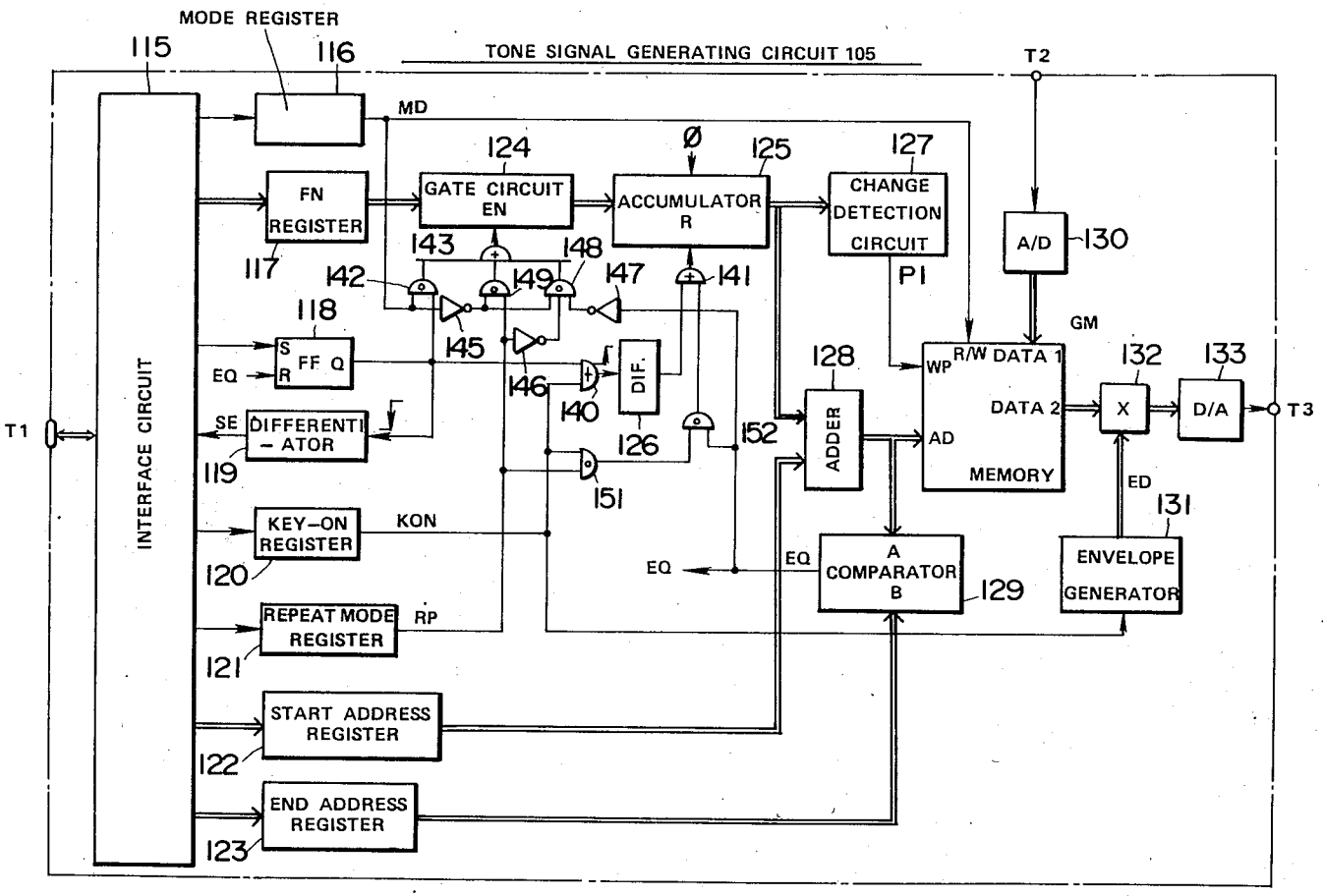
FIG. 7 is a logic block diagram of the tone signal generating circuit 105 of the electronic musical instrument 100 of FIG. 1.

When the operator selects the full sampling mode (1) by depressing the switch 102*a*, data of "1" is written in each of the registers MODE and FULL (FIG. 5), and at the same time data of "1" is written into the mode register 116 (FIG. 7). Then, when the operator depresses the key corresponding to the pitch of the tone to be stored, the frequency number FN corresponding to the tone name of the depressed key is first written into the FN register 117 (step SK4 of FIG. 14), and, subsequently, data representative of the addresses A1 and A5 are written into the start address and end address registers 122 and 123, respectively (step SK6 of FIG. 14). When the operator depresses the start switch 102*c*, the flip-flop 118 is set to "1" (step SS1 of FIG. 12).

When the flip-flop 118 is set to "1", an output signal of the OR gate 140 in the tone signal generating circuit 105 (FIG. 7) rises from "0" to "1" whereupon the differentiator 126 outputs a pulse signal. This pulse signal is supplied through the OR gate 141 to the reset terminal R of the accumulator 125, so that the accumulator 125 is reset to "0". When the flip-flop 118 is set to "1", the output signal MD from the mode register 116 is "1" (sampling mode), so that the AND gate 142 outputs a "1" signal which is supplied through the OR gate 143 to the gate circuit 124. As a result, the gate circuit 124 opens, and the frequency number FN contained in the FN register 117 is transferred to the accumulator 125 and accumulated. The accumulation result is added to the data representative of the address A1 from the start address register 122 by the adder 128, and this addition result is supplied to the address input terminal AD of the memory GM. On the other hand, each time the output of the accumulator changes (i. e, each time the address data changes), the change detection circuit 127 outputs the pulse signal P1 which is supplied to the write pulse input terminal WP of the memory GM. As a result, the data from the A/D converter 130 (i. e., digitized data of the output of the microphone 104) are sequentially written into the memory GM. When the output of the adder 128 coincides to the data representative of the address A5 contained in the end address register 123, the comparator 129 outputs the coincidence signal EQ of "1" which is supplied to the reset terminal R of the flip-flop 118. Consequently, the flip-flop 118 is reset to "0", so that the differentiator 119 outputs the pulse signal SE representative of the completion of sampling at the trailing edge of the output from the flip-flop 118. In response to the pulse signal SE, the CPU 107 writes a "0" into the mode register 116 (step SE2 of FIG. 16), and turns off the LED indicators 103*a* and 103*b* on the control panel 102 (step SE3). Thus, the sampled data of the tone received by the microphone 104 are written into the areas GM1 to GM4 of the memory GM.

(b) Part Sampling Mode

When the operator selects this mode and then depresses the key in the key zone K1 corresponding to the pitch of the first tone to be stored, a "1" is written into the mode register 116, and at the same time the frequency number FN corresponding to the tone name of the depressed key is written into the FN register 117 (step SK4 of FIG. 14). Also, data indicative of the addresses A1 and A2 - 1 are written into the start address and end address registers 122 and 123, respectively, (step SK7). Then, when the operator depressed the start switch 102*c*, the flip-flop 118 is set to "1". Thereafter, in the same manner as the aforesaid case (a), the sampled data of the first tone are written into the area GM1 of the memory GM. When the writing of sampled data is completed, the LED indicator 103*b* is turned off. Then, the operator again selects this part sampling mode (2) by depressing the part switch 102*b* (in this case, the LED indicator 103*b* is turned on), and causes the second tone to be stored into the second area GM2 of the memory GM. The operator then causes the third and fourth tones to be stored respectively into the third and fourth areas GM3 and GM4 in the similar manner.

(c) Full Play Mode

When the operator selects this mode, a "0" is written into the mode register 116. Then, the operator plays a music on the keyboard 101.

Description will first be given as to the case where a "0" is stored in the repeat mode register 121. In this case, when a "0" is written into each of the registers 116 and 121, both of the output signals MD and RP of the registers 116 and 121 are rendered "0", so that the outputs of the inverters 145 and 146 both become "1". At this time, the output signal EQ of the comparator 129 is "0", and therefore the output of the inverter 147 is "1". As a result, the AND gate 148 outputs a "1" signal which is supplied through the OR gate 143 to the gate circuit 124, whereby the gate circuit 124 is opened. Then, when the operator depressed a key on the keyboard 101, the frequency number FN for the full play mode (3) is stored into the FN register 117 (step SK9 of FIG. 14), and data indicative of the addresses A1 and A5 are stored into the start address and end address registers 122 and 123, respectively (step SK10). Also, a "1" is stored into the key-on register 120 (step SK11). When the "1" is stored into the key-on register 120, the key-on signal KON rises to "1", so that the envelope data ED is rendered "1". On the other hand, when the frequency number FN stored in the FN register 117 is supplied through the gate circuit 124 to the accumulator 125, the frequency number FN is accumulated in the accumulator 125. This accumulation result is added to the data representative of the address A1 from the register 122, and the result of this addition is supplied to the address input terminal AD of the memory GM. As a result, the sampled data are sequentially read from the areas GM1 to GM4 of the memory GM and multiplied at the multiplier 132 by the envelope data ED, respectively. Each of the multiplication results is converted by the D/A converter 133 into an analog signal which is supplied to the sound system 106 to produce a musical sound.

When the output of the adder 128 coincides to the data indicative of the address A5 from the end address register 123 (i. e., when the reading of the sampled data from the areas GM1 to GM4 is completed), the coincidence signal EQ of "1" is outputted from the comparator 129. As a result, the output of the inverter 147 becomes "0", so that the output of the OR gate 143 is rendered "0". Consequently, the gate circuit 124 closes to render the output thereof "0", and therefore the output of the accumulator 125 does not change thereafter. Thus, the reading of the sampled data from the memory GM is stopped. As described above, in the full play mode (3), when the repeat mode register 121 stores "0", the whole data in the memory GM are read out only once, and the tone signal is formed from the read-out data.

On the other hand, in the case where the repeat mode register 121 stores "1", the AND gate 149 continues to output a "1" signal so long as the signal MD is "0". And therefore, the gate circuit 124 is held in the open state to always supply the frequency number FN from the FN register 117 to the accumulator 125. On the other hand, when the output signal KON from the key-on register 120 is rendered "1", the AND gate 151 outputs a "1" signal which is supplied to the AND gate 152 to open it. And therefore, when the coincidence signal EQ is outputted at the time when the whole data have once been read from the memory GM, the signal EQ is supplied through the AND gate 152 and the OR gate 141 to the reset terminal R of the accumulator 125. As a result, the accumulator 125 is reset to "0". Thereafter, the accumulation of the frequency number FN is again performed by the accumulator 125, and the reading of the whole data from the memory GM is carried out in accordance with the accumulation. And, the above operation is repeated.

When the depressed key is released, a "0" is written into the key-on register 120 (step SO3 of FIG. 15), and the output signal KON of the register 120 is rendered "0". Once the signal KON becomes "0" , the envelope data ED thereafter gradually decreases, so that the tone signal is gradually decreased and stopped.

(d) Part Play Mode

The operation of the circuit in this part play mode (4) is substantially the same as that in the full play mode (3) and differs therefrom only in the following respects. The frequency number FN stored into the FN register 117 in response to a depression of key is one of those for the part play mode (4) (step SK12 of FIG. 14). A pair of address data corresponding to the key zone of the manipulated key are read from the address area 109*c* (FIG. 4) and stored into the start address and end address registers 122 and 123 (step SK13 of FIG. 14), respectively.

With the above-described embodiment, the sampling of tone is initiated when the start switch 102*c* is depressed. However, the embodiment can be modified so as to comprise a synchro-start switch in place of the start switch 102*c*. In this case, the modified electronic musical instrument is brought into a waiting condition when the synchro-start switch is depressed, and begins the sampling operation when the output of the microphone 104 is detected. The embodiment can also be modified so that the pitch of tone generated based on the sampled tone data can be finely adjusted. Although the output of the A/D converter 130 is directly stored in the memory GM in the above-described embodiment, the output of the A/D converter 130 may be modulated by a DPCM or an ADPCM method before being stored in the memory GM. In this case, the data read from the memory GM must be demodulated to restore the original data. According to this modification, the storage capacity of the memory GM can be saved. The embodiment may also be modified to further comprise an ordinary musical tone generating circuit so that a tone based on an output of an ordinary tone source circuit can be produced in addition the tone based on the sampled tone data.

As described above, with the structure of the electronic musical instrument according to the present invention, tones more complicated in waveshape than those generated by the conventional electronic musical instrument can be generated.

What is claimed is:

1. An electronic musical instrument comprising:

mode selection means for selecting one of a plurality of modes including sampling and play modes, said mode selection means outputting a mode signal representative of the selected mode;

transducer means for converting a tone into a tone signal representative of said tone;

memory means comprising a plurality of storage areas each having a plurality of addresses;

read/write rate designation means for outputting a first rate signal designating a first rate of access to the addresses of said memory means when said mode signal represents said sampling mode, and for outputting a second rate signal designating a second rate of access to the addresses of said memory means when said mode signal represents said play mode;

storage area designation means for designating one of said plurality of storage areas and for outputting an area signal indicative of the designated storage area;

read/write control means responsive to said mode signal, said first rate signal and said area signal for storing data representing said tone signal into the addresses in said designated storage area only at said first rate when said mode signal represents said sampling mode, and responsive to said mode signal and said second rate signal for reading data from the addresses in said plurality of storage areas at said second rate when said mode signal represents said play mode; and tone generating means for generating a tone in accordance with the data read from said memory means.

2. An electronic musical instrument according to claim 1 further comprising a keyboard having a plurality of keys, said read/write rate designation means outputting said first rate signal in response to depression of any one of said keys, said first rate corresponding to a pitch of tone designated by said depressed key.

3. An electronic musical instrument according to claim 1 further comprising a keyboard having a plurality of keys, said read/write rate designation means outputting said second rate signal in response to depression of any one of said keys, said second rate corresponding to a pitch of tone designated by said depressed key.

4. An electronic musical instrument according to claim 1 further comprising a keyboard having a plurality of key zones each having a plurality of keys, said plurality of key zones corresponding respectively to said plurality of storage areas, said storage area designation means outputting said area signal in response to depression of any one of the keys of said keyboard, said area signal designating the storage area corresponding to the key zone to which said depressed key belongs.

5. An electronic musical instrument according to claim 1 wherein said read/write control means comprises an accumulator and a memory storing a plurality of data representative of different frequencies one of which is read therefrom in response to either of said first and second rate signals, said accumulator accumulating said data read from said memory to produce address data for accessing the addresses of said memory means.

6. An electronic musical instrument according to claim 5, wherein said read/write control means further comprises a register for storing data indicative of the address to be first accessed and an adder for adding an output of said accumulator to said data contained in said register, an output of said adder being said address data for accessing the addresses of said memory means.

7. An electronic musical instrument comprising:

mode selection means for selecting one of a plurality of modes including sampling and play modes, said mode selection means outputting a mode signal representative of the selected mode;

transducer means for converting a tone into a tone signal representative of the tone;

memory means comprising a plurality of storage areas each having a plurality of addresses;

read/write rate designation means for outputting a first rate signal designating a first rate of access to the addresses of said memory means when said mode signal represents said sampling mode, and for outputting a second rate signal designating a second rate of access to the addresses of said memory means when said mode signal represents said play mode;

storage area designation means for designating one of said plurality of storage areas and for outputting an area signal indicative of the designated storage area;

read/write control means responsive to said mode signal and said first rate signal for storing data representing said tone signals into the addresses in said plurality of storage areas at said first rate when said mode signal represents said sampling mode, and responsive to said mode signal, said second rate signal and said area signal for reading data from the addresses in said designated storage area only at said second rate when said mode signal represents said play mode; and tone generating means for generating a tone in accordance with the data read from said memory means.

* * * * *